US005449077A

United States Patent [19]

Seidler

[11] Patent Number: 5,449,077

[45] Date of Patent: Sep. 12, 1995

[54] BOTTLE WITH CHILD RESISTANT CAP

[76] Inventor: David Seidler, 69-10 108th St., Forest Hills, N.Y. 11375

[21] Appl. No.: 305,456

[22] Filed: Sep. 13, 1994

[51] Int. Cl.[6] ..... B65D 55/02

[52] U.S. Cl. ..... 215/216; 215/206; 215/221

[58] Field of Search ..... 215/206, 216, 221, 222

[56] References Cited

U.S. PATENT DOCUMENTS

| | | | |
|---|---|---|---|
| 3,612,323 | 10/1971 | Malick | 215/214 |
| 3,703,975 | 11/1972 | Wittemer . | |
| 3,776,406 | 12/1973 | Milbourne, Sr. | 215/216 |
| 3,881,639 | 5/1975 | Herip . | |
| 3,913,769 | 10/1975 | Scrocco et al. . | |
| 3,923,181 | 12/1975 | Libit | 215/224 |
| 3,935,963 | 2/1976 | Knize . | |
| 4,154,354 | 5/1979 | Ryder . | |
| 4,413,742 | 11/1983 | Sandhaus . | |
| 4,462,501 | 7/1984 | Franchi . | |
| 4,464,316 | 8/1984 | Michaels . | |
| 4,479,585 | 10/1984 | Sandhaus | 215/218 |
| 4,480,762 | 11/1984 | Thomas | 215/273 |
| 4,533,058 | 8/1985 | Uhlig . | |
| 4,588,097 | 5/1986 | Hauser | 215/216 |
| 4,752,013 | 6/1988 | Miller et al. | 215/216 |
| 4,752,014 | 6/1988 | House et al. | 215/216 |
| 4,787,526 | 11/1988 | Pehr . | |
| 4,807,768 | 2/1989 | Gach . | |
| 4,821,896 | 4/1989 | Cheng . | |
| 4,838,441 | 6/1989 | Chernack . | |
| 5,040,691 | 8/1991 | Hayes et al. . | |
| 5,143,234 | 9/1992 | Lohrman et al. . | |
| 5,205,424 | 4/1993 | Gaspar . | |

*Primary Examiner*—Allan N. Shoap
*Assistant Examiner*—Vanessa Caretto
*Attorney, Agent, or Firm*—Stroock & Stroock & Lavan

[57] ABSTRACT

A bottle having an open neck with an outer surface. The neck includes a thread finish formed on the outer surface thereof having a predetermined thickness along its length. A cap having an inner surface releaseably threadable on the neck includes at least one pivotable arm with a thread thereon facing the inner surface of the cap and selectively engageable with the thread finish on the neck when the cap is threaded on the bottle. The arm is pivotable between a first position where the thread is positioned adjacent the inner surface of the cap and a second position where the thread is moved outwardly away from the inner surface. The thread is captured below the thread finish when the cap is threaded on the neck to lock the cap on the bottle. The thread finish includes at least a first reduced thickness region sized to permit the thread to bypass the reduced thickness region when the arm is pivoted to its second position to permit the cap to be removed from the bottle.

21 Claims, 3 Drawing Sheets

FIG. 8
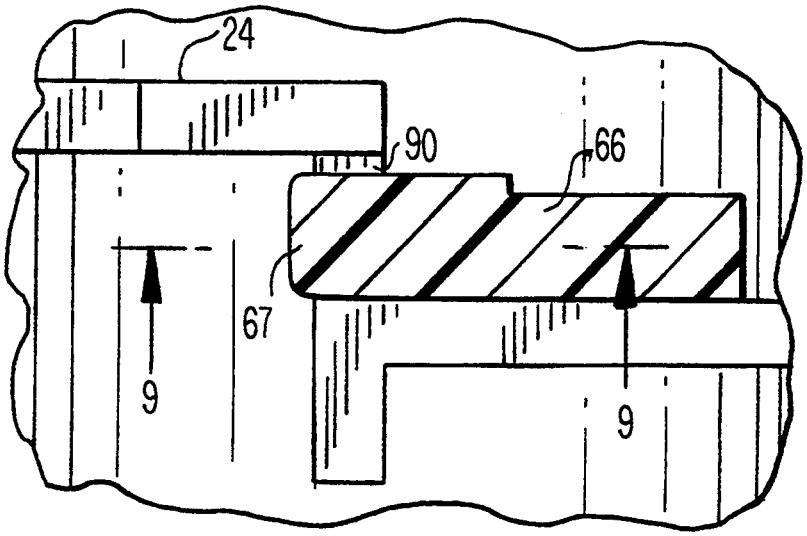
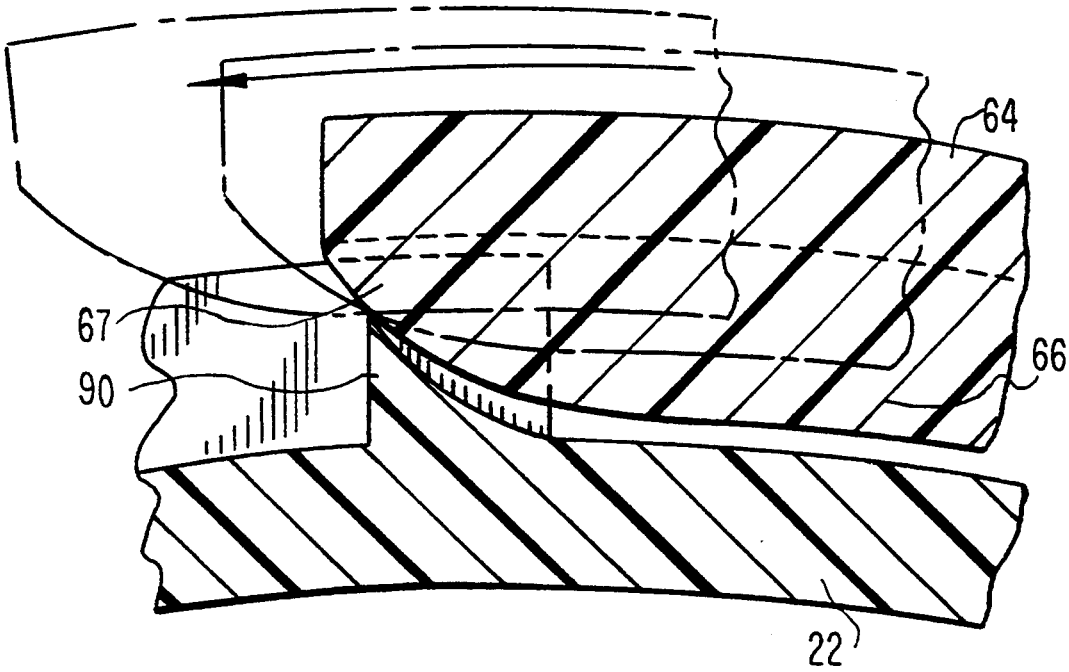
FIG. 9

BOTTLE WITH CHILD RESISTANT CAP

BACKGROUND OF THE INVENTION

The present invention is directed generally to a bottle with child resistant cap and, in particular, to a special construction for the neck of the bottle and the corresponding cap which requires a sequence of actions to be followed to allow for removal of the cap from the bottle. Such construction renders the configuration child resistant.

The need for child resistant pill and product containers which might contain medicine in various pill, tablet, capsule or liquid form is well documented. Various constructions have been proposed over the years which provide child-resistant properties and which make it most difficult for young children to open the containers thereby preventing overdosing and, perhaps, poisoning.

In my co-pending U.S. patent application Ser. No. 08/213,877 filed on Mar. 15, 1994, I describe various prior art constructions and note the problems associated therewith. In my co-pending application, I describe a new child-resistant product dispenser construction that I invented. Such construction includes a trackway and corresponding projection to permit selected axial displacement of the cap with respect to the bottle only upon a predetermined orientation of the cap with respect to the bottle. It is only upon such axial displacement that the contents of the bottle can be removed.

There is a need for even more and different bottle constructions with child-resistant caps. The present invention provides such a construction. Accordingly, it is desirable to provide a new and improved bottle with child-resistant cap.

SUMMARY OF THE INVENTION

Generally speaking, in accordance with the present invention, a bottle having an open neck, the neck having an outer surface, is provided. The bottle includes a thread finish formed on the outer surface of the neck and having a predetermined thickness along its length. The bottle also includes a removable cap having an inner surface releaseably threadable on the neck. The cap has at least one pivotable arm with a thread thereon facing the inner surface of the cap and selectively engageable with the thread finish on the neck when the cap is threaded on the bottle. The arm is pivotable between a first position where the thread is positioned adjacent the inner surface of the cap and a second position where the thread is moved outwardly away from the inner surface of the cap. The thread is captured below the thread finish when the cap is threaded on the neck to lock the cap on the bottle. The thread finish includes at least a first reduced thickness region sized to permit the thread to bypass the reduced thickness region when the arm is pivoted to its second position to permit the cap to be removed from the bottle.

In a preferred embodiment, the cap includes first and second opposed pivotable arms, each having an inwardly facing thread. The thread finish includes two corresponding reduced thickness regions such that when the cap is rotated and the arms are squeezed towards one another, the threads thereon will be pivoted away from the thread finish permitting the threads to bypass the corresponding reduced thickness regions, whereafter the cap can be removed from the bottle.

Also, the thread finish may include entrance ramps to permit automatic pivoting of the threads away from the neck when the cap is initially threaded on the bottle so that the threads are captured below the thread finish to permit the locking of the cap on the bottle.

Accordingly, it is an object of the present invention to provide an improved bottle with child-resistant cap.

Another object of the present invention is to provide a bottle with a child-resistant cap which can be removed from the neck of the bottle only after a certain sequence of actions has been followed.

A further object of the present invention is to provide a bottle with child-resistant cap that can be automatically rethreaded on the bottle in locked condition.

Still other objects and advantages of the invention will in part be obvious and will in part be apparent from the specification.

The invention accordingly comprises the features of construction, combinations of elements, and arrangement of parts which will be exemplified in the construction hereinafter set forth and the scope of the invention will be indicated in the claims.

BRIEF DESCRIPTION OF THE DRAWINGS

For a fuller understanding of the invention, reference is had to the following description taken in connection with the accompanying drawings, in which:

FIG. 8 is an enlarged view of the thread entrance ramp of the thread finish and a corresponding thread; and FIG. 9 is a an enlarged sectional view taken along line 9—9 of FIG. 8.

DETAILED DESCRIPTION OF THE PREFERRED EMBODIMENT

Figures 1, 2, 3, 4:
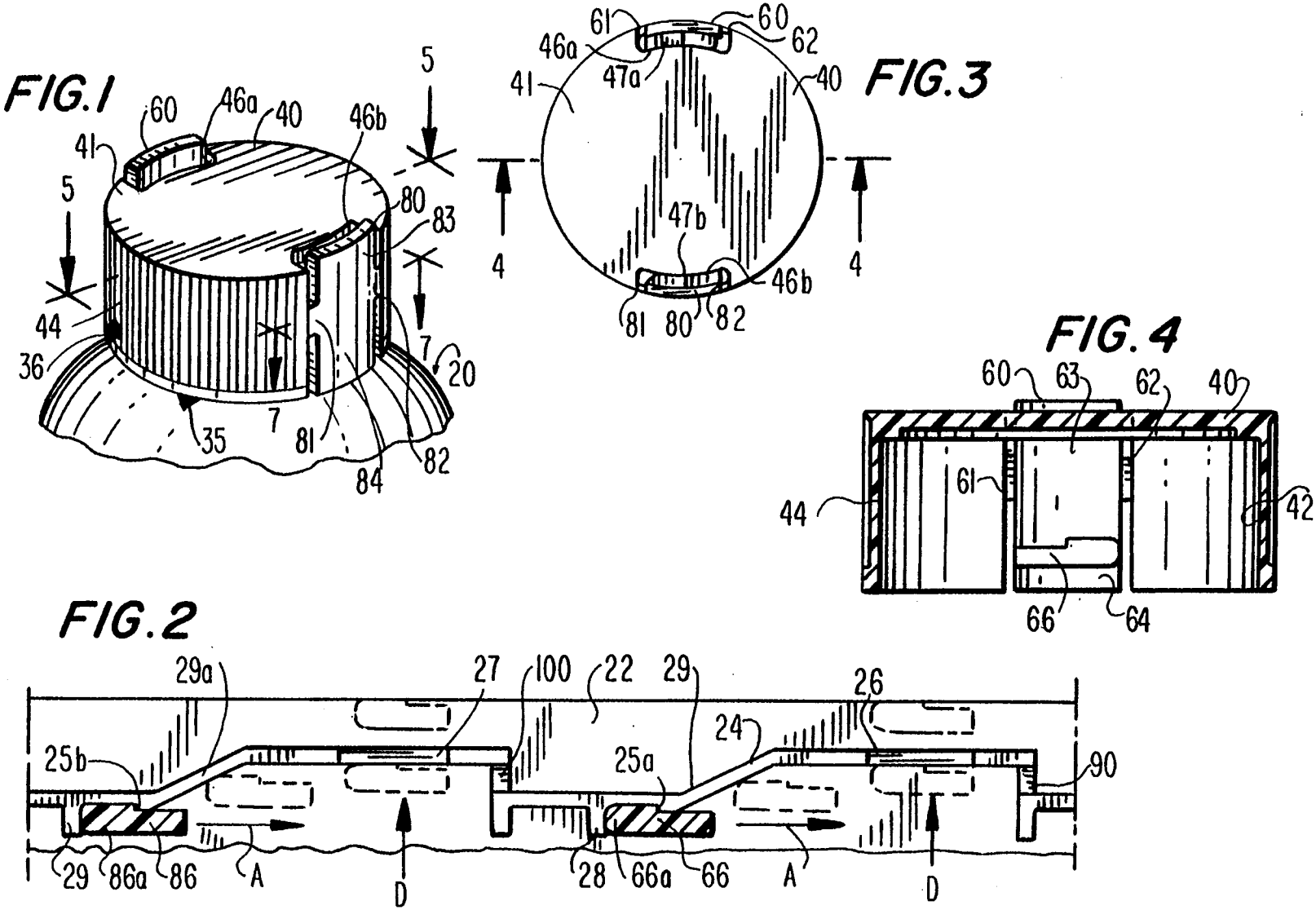
FIG. 1 is a top perspective view of the upper portion of a bottle with a child-resistant cap constructed in accordance with a preferred embodiment of the present invention.
FIG. 2 is a developed view of the neck portion of the bottle of FIG. 1 showing the thread finish pattern thereon and the interaction with corresponding threads on the bottle cap.
FIG. 3 is a top plan view of the bottle cap.
FIG. 4 is an enlarged sectional view taken along line 4—4 of FIG. 3.
Figure 6:
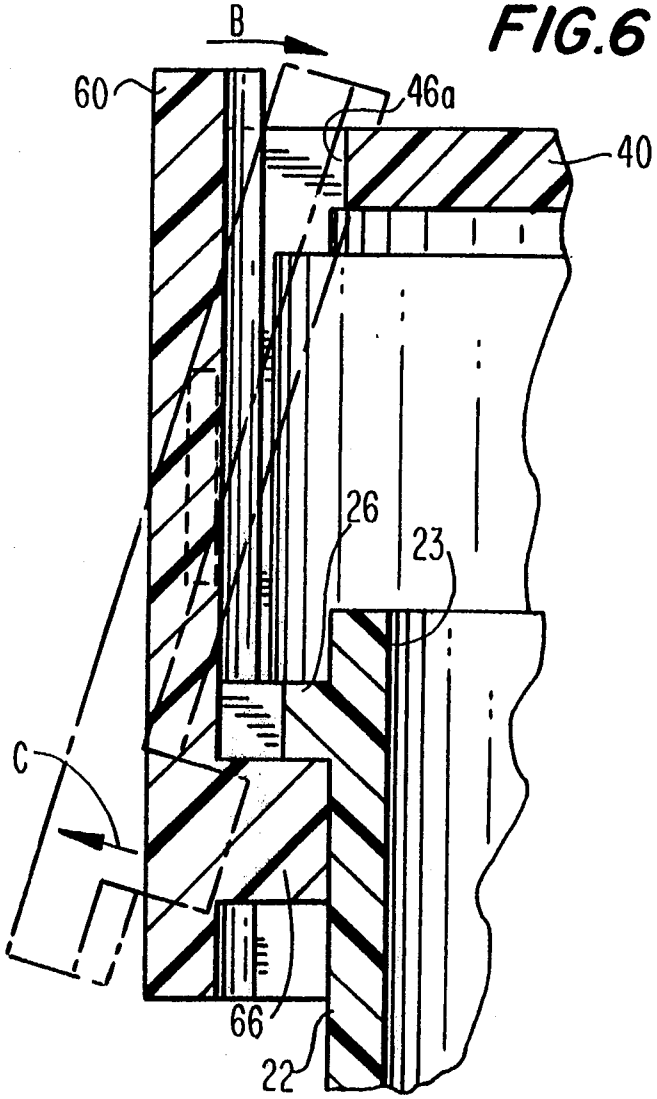
FIG. 6 is a sectional view taken along line 6—6 of FIG. 5, with the arm also shown in phantom in a pivoted position.
Figure 5:
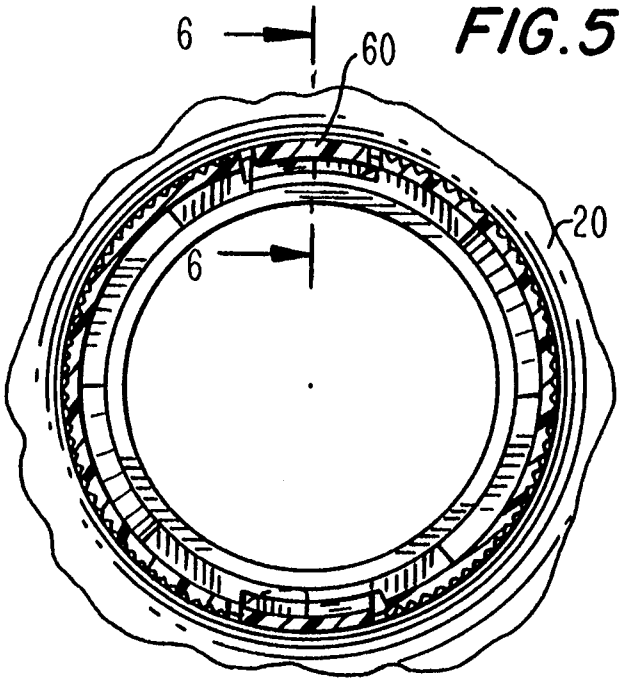
FIG. 5 is an enlarged sectional view taken along line 5—5 of FIG. 1.
Figure 7:
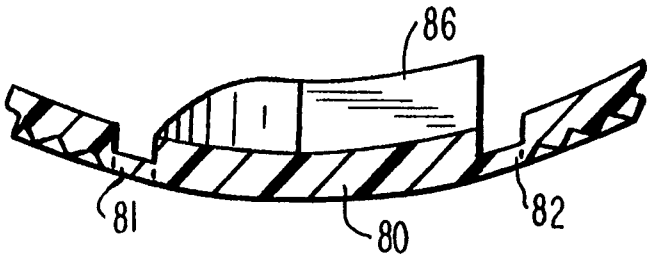
FIG. 7 is an enlarged sectional view taken along line 7—7 of FIG. 1.

Reference is first made to FIG. 1 of the drawings which depicts the upper portion of a bottle 20 having a removable cap 40 threaded thereon. Cap 40 includes opposed pivotable arms 60 and 80, the purpose of which will be described in detail below.

Referring now additionally to FIGS. 2 through 7, it is seen that bottle 20 includes an upstanding neck 22 which defines an opening 23 through which the contents of bottle 20 can be removed after cap 40 has been removed therefrom.

A thread finish 24 having the configuration best depicted in FIG. 2 is formed on the outer surface of neck 22. It is seen that the pattern of thread finish 24 repeats itself once around the outer circumference of neck 22. Thread finish 24 has a predetermined thickness along its length except at strategically located regions, the purpose and location of which will hereinafter be described in detail.

Cap 40 is hollow, has a closed top surface 41, and includes an inner surface 42. Upstanding neck 22 is received in the hollow portion of cap 40. Each of arms 60 and 80 have a similar construction and configuration. Arm 60 is pivotally coupled to sidewall 44 of cap 40 through opposing hinges 61 and 62. The central location of hinges 61 and 62 define an upper region 63 and a lower region 64 for arm 60. Similarly, arm 80 includes opposing hinges 81 and 82 to define an upper region 83 and a lower region 84. It is noted that each of upper regions 63 and 83 extend slightly above the top surface 41 of cap 40.

The inner surface of lower region 64 of arm 60 includes a thread 66 which, through pivoting of upper region 63 of arm 60 can be moved away from neck 22. Similarly, the inner surface of lower region 84 of arm 80 includes a thread 86.

Thread finish 24, as aforenoted, has a predetermined thickness along its length except at defined regions. As depicted in FIG. 2, it is seen that thread finish 24 includes a reduced thickness region at 26 of a length sufficient to permit thread 66 to pass over the thread finish at the reduced thickness region 26 when pivoted away therefrom. Since the pattern of thread finish 24 repeats once, there is also a reduced thickness region 27 for corresponding thread 86 on pivotable arm 80.

When cap 40 is fully threaded on neck 22 of bottle 20, threads 66 and 86 will be in the position depicted in FIGS. 1 and 2 adjacent vertical walls 28 and 29 of thread finish 24, respectively. It is noted that threads 66 and 86 each include a beveled surface **66*a* and 86*a*, respectively, which rests against a corresponding beveled surface 25*a* and 25*b*, respectively, in thread finish 24, when cap 40** is in the fully locked position. This lug finish construction acts to seal the cap against the top horizontal surface of the neck. It is noted that the lug finish could be replaced with a further thread finish to permit tightening by torque turning action.

As cap 40 is manually rotated counterclockwise in the direction of arrow A, threads 66 and 86 will be moved in the same direction but will remain trapped below thread finish 24 due to the thickness of thread finish 24. However, if cap 40 is rotated such that threads 66 and 86 are aligned respectively with reduced thickness regions 26 and 27, and then the upper portions of pivotable arms 60 and 80 are squeezed towards one another in the direction of arrow B of FIG. 6, the lower portion of arms 60 and 80 will be pivoted outwardly in the direction of arrow C, thereby also moving threads 66 and 86 away from neck 22 and hence thread finish 24, as best depicted in phantom in FIG. 6. Threads 66 and 68, by squeezing arms 60 and 80 towards one another, are pivoted outwardly a sufficient amount to clear reduced thickness regions 26 and 27, respectively, so that cap 40 can be pulled upwardly in the direction of arrows D in FIG. 2 thereby allowing cap 40 to be removed from bottle 20.

Note, however, that the top surface 41 of cap 40 includes cut-out regions **46*a* and 46*b* with stops 47*a* and 47*b* so that when arms 60 and 80 are pivoted towards one another into the cut-out regions they will contact respective stops 47*a* and 47*b* to prevent further pivoting. Threads 66 and 86 will then clear the reduced thickness regions but not the other regions of thread finish 24**.

It is noted that bottle 20 may include an indicia mark 35 and cap 40 may include a corresponding indicia mark 36, which, when aligned by rotation of cap 40, will show where to locate the cap to align the threads with the reduced thickness regions, before squeezing the arms and pulling upwardly. It is also noted that the location of the reduced thickness regions could be moved to be adjacent a vertical wall on the thread so that visual aligning of indicia marks would be unnecessary.

When cap 40 is replaced on neck 22, in order to thread cap 40 thereon, it is necessary to reposition threads 66 and 86 below thread finish 24. In this regard, thread finish 24 includes vertical entrance ramps 90 and 100. Reference is now made additionally to FIGS. 8 and 9 to explain the construction of the ramps and the cap reapplication procedure. When cap 40 is placed on neck 22, threads 66 and 86 will ride along the top of thread finish 24 as cap 40 is rotated in a clockwise direction and will be directed by inclined portions 29 and **29*a* of track finish 24 towards vertical ramps 90 and 100, respectively. As the curved front 67 of thread 66 rides against ramp 90, lower portion 64 of arm 60 will be automatically pivoted away from neck 22 until thread 66 clears the ramp, at which time hinges 61 and 62 will allow the thread to return to its original position and will be locked under thread finish 24. The same procedure applies to thread 86. Continued clockwise rotation of cap 40 will cause threads 66 and 86 to follow inclined surfaces 29 and 29*a*, respectively, until they reach their final destination, the position shown in FIG. 2**, the fully closed position.

Accordingly, the present invention provides a bottle with a child-resistant cap which requires a sequence of actions before the cap can be removed or fully unthreaded from the bottle. Rotation, axial displacement and pivoting movements are necessary thereby providing enhanced child-resistant properties to the package.

It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A bottle having an open neck, said neck having an outer surface, comprising a thread finish formed on the outer surface of said neck and having a predetermined thickness along its length, and a cap having an inner surface releaseably threadable on said neck, said cap having at least one pivotable arm with a first thread thereon facing the inner surface of said cap and selectively engageable with said thread finish on said neck when said cap is threaded on said bottle, said arm being pivotable between a first position where said first thread is positioned adjacent the inner surface of said cap and a second position where said first thread is moved outwardly away from said inner surface, said thread being captured below said thread finish when said cap is threaded on said neck to lock said cap on said bottle, said thread finish including at least a first reduced thickness region sized to permit said first thread to bypass said reduced thickness region when said arm is pivoted to its second position to permit said cap to be removed from said bottle.

2. The bottle as claimed in claim 1, wherein said cap includes a second pivotable arm opposite to said first pivotable arm, said second pivotable arm including a second thread thereon facing the first thread on said first arm and selectively engageable with said thread finish on said neck when said cap is threaded on said bottle, said second arm being pivotable between said first and second positions.

3. The bottle as claimed in claim 2, wherein said thread finish includes a second reduced thickness region to permit said second thread to bypass said second reduced thickness region when said second arm is pivoted to its second position.

4. The bottle as claimed in claim 3, wherein said first and second reduced thickness regions are positioned on said thread finish to correspond to the locations of said first and second threads on said cap.

5. The bottle as claimed in claim 1, wherein said cap includes a stop to prevent said first arm from being pivoted beyond said second position.

6. The bottle as claimed in claim 3, wherein said cap includes first and second stops to prevent said first and second arms, respectively, from being pivoted beyond said second positions.

7. The bottle as claimed in claim 6, wherein said first and second arms extend above the upper surface of said cap.

8. The bottle as claimed in claim 1, wherein said thread finish includes an inclined surface to direct said first thread to a locked position.

9. The bottle as claimed in claim 3, wherein said thread finish includes first and second inclined surfaces to direct said respective first and second threads to a locked position.

10. The bottle as claimed in claim 3, wherein said first and second threads each include a lug finish to releaseably hold said cap in a fully closed position.

11. The bottle as claimed in claim 10, wherein said lug finish of said first thread and second thread includes beveled surfaces, and said thread finish includes corresponding beveled surfaces which cooperate to releaseably hold said cap in a fully closed position.

12. The bottle as claimed in claim 1, wherein said thread finish includes a first entrance ramp, said first thread contacting said entrance ramp and being moved outwardly towards its second position to permit said first thread to enter below said thread finish when said cap is initially threaded onto said neck.

13. The bottle as claimed in claim 12, wherein said first thread includes a curved forward end which contacts and rides up said ramp when said cap is initially threaded onto said bottle.

14. The bottle as claimed in claim 13, wherein said first thread returns to its first position after said first thread has cleared said entrance ramp.

15. The bottle as claimed in claim 14, wherein said thread finish includes an inclined surface to direct said first thread towards said entrance ramp when said cap is initially threaded onto said bottle.

16. The bottle as claimed in claim 12, wherein said thread finish includes a second entrance ramp, said second thread contacting said second entrance ramp and being moved outwardly towards its second position to permit said second thread to enter below said thread finish when said cap is initially threaded onto said neck.

17. A bottle having an open neck, said neck having an outer surface, comprising a thread finish formed on the outer surface of said neck and having a predetermined thickness along its length, and a cap having an inner surface releaseably threadable on said neck, said cap having first and second opposing pivotable arms, said first arm having a first thread and said second arm having a second thread, said first and second threads facing the inner surface of said cap and being selectively engageable with said thread finish on said neck when said cap is threaded on said bottle, said first and second arms each being pivotable between a first position where said first and second threads are positioned adjacent the inner surface of said cap and a second position where said first and second threads are moved outwardly away from said inner surface, said first and second threads being captured below said thread finish when said cap is threaded on said neck to lock said cap on said bottle, said thread finish including first and second reduced thickness regions sized to permit said first and second threads, respectively, to bypass said first and second reduced thickness regions, respectively, when said arms are pivoted to their second position to permit said cap to be removed from said bottle.

18. The bottle as claimed in claim 17, wherein said first and second arms include centrally located hinge means to pivotally couple said arms to the side of said cap.

19. The bottle as claimed in claim 18, wherein said hinge means permit the upper ends of said arms to be moved towards one another to displace said first and second threads towards their second position.

20. The bottle as claimed in claim 19, wherein said cap includes stop means to prevent said first and second arms from being pivoted beyond said second positions.

21. The bottle as claimed in claim 17, wherein said bottle and cap including corresponding indicia, which, when aligned, position said first and second threads adjacent said first and second reduced thickness regions, respectively.

* * * * *